US010731409B2

(12) United States Patent
Chen

(10) Patent No.: US 10,731,409 B2
(45) **Date of Patent: *Aug. 4, 2020**

(54) DOUBLE-LAYER CORD ROLLING DEVICE FOR WINDOW BLIND WITHOUT EXPOSED PULL CORD

(71) Applicant: SHEEN WORLD TECHNOLOGY CORPORATION, Taichung (TW)

(72) Inventor: Po-Yu Chen, Taichung (TW)

(73) Assignee: SHEEN WORLD TECHNOLOGY CORPORATION, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 16/412,715

(22) Filed: May 15, 2019

(65) Prior Publication Data

US 2020/0217128 A1 Jul. 9, 2020

(30) Foreign Application Priority Data

Jan. 3, 2019 (TW) ..... 108100217 A

(51) Int. Cl.
*E06B 9/323* (2006.01)
*E06B 9/322* (2006.01)

(52) U.S. Cl.
CPC ..... *E06B 9/322* (2013.01); *E06B 9/323* (2013.01); *E06B 2009/3225* (2013.01)

(58) Field of Classification Search
CPC .. B65H 75/486; B65H 75/4402; B65H 75/34; B65H 79/00; E06B 9/322; E06B 2009/3225; E06B 9/323; F16H 19/0672; F16H 10/0672
See application file for complete search history.

(56) References Cited

U.S. PATENT DOCUMENTS

| | | | | |
|---|---|---|---|---|
| 2012/0280072 | A1* | 11/2012 | Lin | B65H 57/00 242/157 R |
| 2017/0204656 | A1* | 7/2017 | Chen | E06B 9/322 |
| 2017/0211321 | A1* | 7/2017 | Chen | E06B 9/262 |
| 2018/0230739 | A1* | 8/2018 | Huang | E06B 9/322 |
| 2018/0230744 | A1* | 8/2018 | Huang | E06B 9/262 |
| 2018/0291679 | A1* | 10/2018 | Zheng | E06B 9/322 |
| 2019/0093426 | A1* | 3/2019 | Huang | E06B 9/60 |
| 2019/0162016 | A1* | 5/2019 | Chen | B65H 79/00 |

* cited by examiner

*Primary Examiner* — Daniel P Cahn
(74) *Attorney, Agent, or Firm* — Browdy and Neimark, PLLC

(57) ABSTRACT

A double-layer cord rolling device includes a driving unit and a cord rolling unit disposed under the driving unit. The driving unit has an upper base, two upper wheels rotatably disposed on the upper base, and a torsion spring connected with the upper wheels. The cord rolling unit has a lower base, two lower wheels rotatably disposed on the lower base and coaxially mating with the upper wheels, and two transmission cords respectively connected with the lower wheels. One of the upper wheels is connected with one respective lower wheel through a transmission member, thereby rotatable synchronously. As a result, the double-layer cord rolling device of the present invention is shortened in length on the whole without affecting its functioning, thereby attaining the effect of miniaturization.

3 Claims, 3 Drawing Sheets

DOUBLE-LAYER CORD ROLLING DEVICE FOR WINDOW BLIND WITHOUT EXPOSED PULL CORD

BACKGROUND OF THE INVENTION

1. Field of the Invention

The present invention relates to non-pull cord window blinds and more particularly, to a double-layer cord rolling device for the window blind without exposed pull cord.

2. Description of the Related Art

As to the general window blind without exposed pull cord, the lift transmission cord is rolled up by the cord rolling device disposed in the top beam. Because the lift transmission cord is tied to the bottom beam, the bottom beam is gradually moved up relative to the top beam during the process that the lift transmission cord is rolled up, so that the slats of the window blind are folded up by the upwardly moving bottom beam. However, subject to the length of the aforesaid cord rolling device, the aforesaid cord rolling device is likely to interfere with other components of the window blind. Therefore, it would be a desired goal in the window blind field to shorten the length of the aforesaid cord rolling device appropriately without affecting the functioning of the cord rolling device.

SUMMARY OF THE INVENTION

It is a primary objective of the present invention to provide a double-layer cord rolling device for the window blind without exposed pull cord, which is shortened in length, thereby attaining the effect of miniaturization.

To attain the above objective, the present invention provides a double-layer cording device comprises a driving unit, a cording rolling unit, and a transmission member. The driving unit is provided with an upper base, two upper wheels each having two opposite first gears and a first shaft connected with the first gears and rotatably disposed on the upper base, and a torsion spring connected with the first shafts of the upper wheels. The first gears of the upper wheels are engaged with each other, and the first shaft of one of the upper wheels has a first insertion groove. The cord rolling unit is provided with a lower base detachably mounted to the upper base of the driving unit, two lower wheels coaxially mating with the upper wheels of the driving unit and each having two opposite second gears and a second shaft connected with the second gears and rotatably disposed on the lower base, and two transmission cords connected with the second shafts of the lower wheels respectively. The second gears of the lower wheels are engaged with each other, and the second shaft of one of the lower wheels has a second insertion groove. The transmission member has an insertion portion inserted in the first and second insertion grooves, thereby enabling the associated first and second wheels to rotate synchronously.

It can be understood from the above illustration that the driving unit and the cord rolling unit are combined together in a stacking manner, and the transmission member enables the driving unit to drive the cord rolling unit to operate with the driving unit synchronously. As a result, the double-layer cord rolling device is shortened in length on the whole without affecting its functioning, thereby attaining the effect of miniaturization.

DETAILED DESCRIPTION OF THE INVENTION

Figure 1:
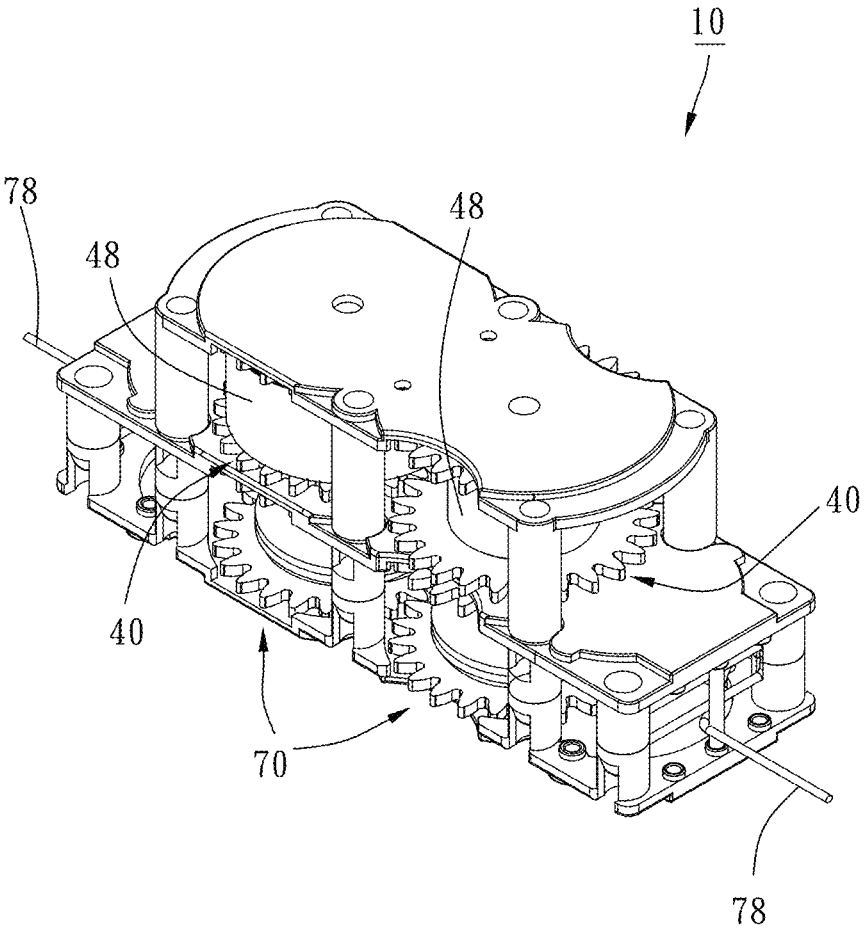
FIG. 1 is a perspective view of a double-layer cord rolling device in accordance with the present invention.

First of all, it is to be mentioned that same reference numerals used in the following preferred embodiments and the appendix drawings designate same or similar elements or structural features thereof.

Figure 2:
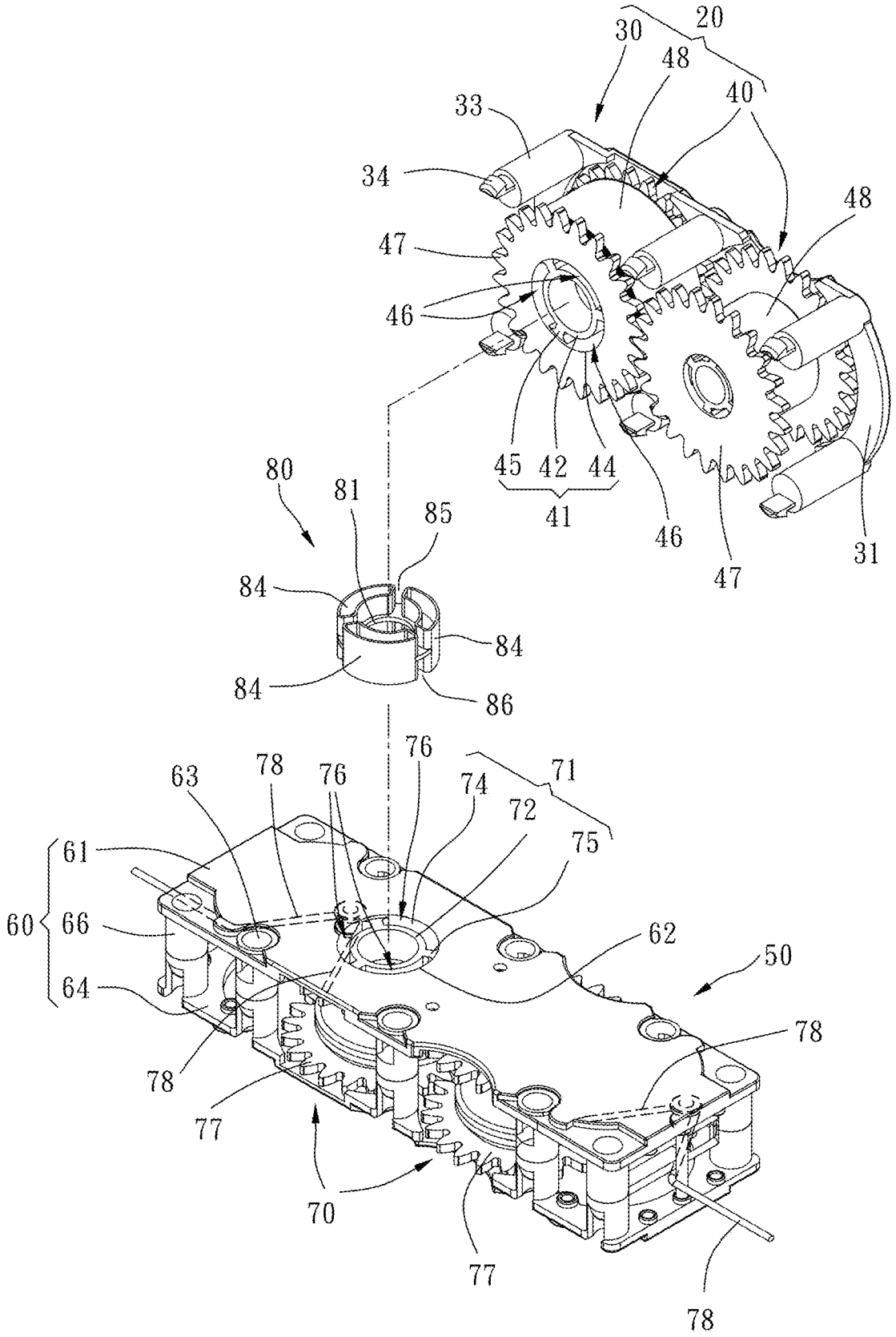
FIG. 2 is a partially exploded perspective view of the double-layer cord rolling device in accordance with the present invention.

Referring to FIGS. 1-2, a double-layer cord rolling device 10 of the present invention comprises a driving unit 20, a cord rolling unit 50, and a transmission member 80.

The driving unit 20 includes an upper base 30, two upper wheels 40 (i.e. left upper wheel and right upper wheel), and a torsion spring 48. The upper base 30 has a cover plate 31 provided at a bottom surface thereof with two first shaft portions 32 (as shown in FIG. 3, FIG. 3 shows one of the two first shaft portions 32), and six first posts 33 integrally connected with two opposite sides of the cover plate 31 in pairs and each provided at a bottom end thereof with a fastening portion 34.

Figure 3:
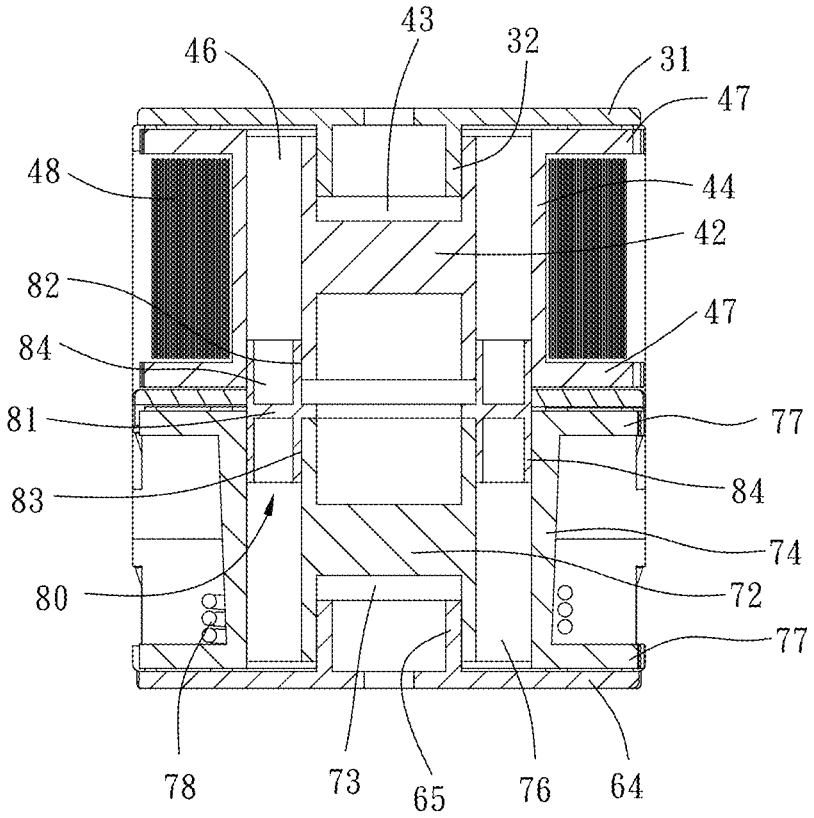
FIG. 3 is a partially sectional view of the double-layer cord rolling device in accordance with the present invention.

The left upper wheel of the upper wheels 40 has a first shaft 41, as shown in FIGS. 2-3. The first shaft 41 has a first inner wall 42 provided at a top end thereof with a first shaft hole 43, a first outer wall 44 coaxially sleeved on the first inner wall 42 and fixedly connected between two first gears 47, and three first ribs 45 integrally connected between the first inner and outer walls 42 and 44 and equiangularly spaced around the center of the first shaft 41 so that a first insertion groove 46 is defined between the first inner wall 42, the first outer wall 44, and the two adjacent first ribs 45. The cross section of the first insertion groove 46 has an arc shape. As a result, the first shaft holes 43 of the left upper wheel of the upper wheels 40 are sleeved on the first shaft portions 32 of the upper base 30 such that the upper wheels 40 are rotatably disposed on the upper base 30; and further, the first gears 47 of the upper wheels 40 are engaged with each other, thereby enabling the upper wheels 40 to rotate synchronously.

The torsion spring 48 is connected with the first outer walls 44 of the first shafts 41 of the left upper wheel and the right upper wheel of the upper wheels 40 for providing resilient force to drive the two upper wheels 40 to rotate synchronously.

The cord rolling unit 50 includes a lower base 60, two lower wheels 70 (i.e. left lower wheel and the right lower wheel), and two transmission cords 78.

The lower base 60 has a top plate 61 and a bottom plate 64. The top and bottom plates 61 and 64 are connected together by using a plurality of second posts 66. The top plate 61 is provided at a top surface thereof with a top hole 62 coaxially mating with the first shaft 41 of one of the upper wheels 40, and six fastening holes 63 corresponding to the fastening portions 34 of the first posts 33 of the upper base 30 one on one. The bottom plate 64 is provided at a top surface thereof with two second shaft portions 65 (as shown in FIG. 3, FIG. 3 shows one of the two second shaft portions 65). In this way, the upper and bottom bases 30 and 60 are combined together in a way that the fastening portions 34 of the upper base 30 are hooked in the fastening holes 63 of the lower base 60. However, the top and bottom bases 30 and 60 can be separated by relief of the hook relation between the fastening portions 34 and the fastening holes 63.

The left lower wheel of the lower wheels 70 has a second shaft 71, as shown in FIGS. 2-3. The second shaft 71 has a second inner wall 72 provided at a bottom end thereof with a second shaft hole 73, a second outer wall 74 coaxially sleeved on the second inner wall 72 and fixedly connected between two second gears 77, and three second ribs 75 integrally connected between the second inner and outer walls 72 and 74 and equiangularly spaced around the center of the second shaft 71 so that a second insertion groove 76 is defined between the second inner wall 72, the second outer wall 74, and the two adjacent second ribs 75. The cross section of the second insertion groove 76 has an arc shape. As a result, the second shaft holes 73 of the left lower wheel of the lower wheels 70 are sleeved on the second shaft portions 65 of the lower base 60 such that the lower wheels 70 are rotatably disposed on the lower base 60; and further, the second gears 77 of the lower wheels 70 are engaged with each other, thereby enabling the lower wheels 70 to rotate synchronously. As shown in FIG. 2, the second shaft 71 of the left lower wheel of the lower wheels 70 coaxially mates with the top hole 62 of the top plate 61 of the lower base 60.

One end of the two transmission cords 78 are attached to the two second outer walls 74 of the second shafts 71 of the left lower wheel and the right lower wheel of the lower wheels 70 respectively. The other end of the two transmission cords 78 are both attached to a bottom beam (not shown).

As shown in FIGS. 2-3, the transmission member 80 has an annular portion 81 and three insertion portions 84 integrally connected with the annular portion 81 and equiangularly spaced around the center of the annular portion 81 so that an upper hole 82 located above the annular portion 81 is defined between the three insertion portions 84, a lower hole 83 located under the annular portion 81 is defined between the three insertion portions 84, an upper notch 85 located above the annular portion 81 is defined between the two adjacent insertion portions 84, and a lower notch 86 located under the annular portion 81 is defined between the two adjacent insertion portions 84. As a result, the transmission member 80 is disposed between the left upper wheel and the left lower wheel of the one pair of the upper and lower wheels 40 and 70 in a way that the upper and lower holes 82 and 83 of the transmission member 80 are sleeved on the first inner wall 42 of the first shaft 41 of the left upper wheel of the upper wheel 40 and the second inner wall 72 of the second shaft 71 of the left lower wheel of the lower wheel 70 respectively, and the top and bottom ends of the three insertion portions 84 of the transmission member 80 are inserted in the first insertion groove 46 of the first shaft 41 of the left upper wheel of the upper wheel 40 and the second insertion groove 76 of the second shaft 71 of the left lower wheel of the lower wheel 70 respectively, and the upper and lower notches 85 and 86 of the transmission member 80 are engaged with the first ribs 45 of the first shaft 41 of the left upper wheel of the upper wheel 40 and the second ribs 75 of the second shaft 71 of the left lower wheel of the lower wheel 70, thereby enabling the associated upper and lower wheels 40 and 70 to rotate together through the transmission member 80.

It can be known from the above description that when the two transmission cords 78 are pulled out to gradually escape from the two lower wheels 70, the two lower wheels 70 are driven to rotate together through their meshing engagement, so that the left lower wheel of the lower wheels 70 drives the left upper wheel of the upper wheel 40 through the transmission member 80, and the left upper wheel of the upper wheels 40 driven by the transmission member 80 drives the right upper wheel of the upper wheels 40 to rotate. By this way, the torsion spring 48 is stretched by the two upper wheels 40, and the resilient force of the torsion spring 48 is saved.

When the pulling force applied on the two transmission cords 78 is relieved, the resilient force of the torsion spring 48 is applied on the two upper wheels 40 to rotate reversely and synchronously. The left upper wheel of the upper wheels 40 drives the left lower wheel of the lower wheels 70 through the transmission member 80, and the left lower wheel of the lower wheels 70 driven by the transmission member 80 drives the right lower wheel of the lower wheel 70 to rotate through their meshing engagement, so that the two lower wheels 70 roll up the associated transmission cords 78 respectively.

In conclusion, in the double-layer cord rolling device 10 of the present invention, the driving unit 20 and the cord rolling unit 50 are combined together in a stacking manner, and the transmission member 80 is used for transmitting power. As a result, the double-layer cord rolling device 10 is shortened in length on the whole without affecting the functioning thereof, thereby attaining the effect of miniaturization.

What is claimed is:

1. A double-layer cord rolling device comprising:

a driving unit having an upper base, a left upper wheel, a right upper wheel and a torsion spring, the left upper wheel and the right upper wheel being both provided with two opposite first gears and a first shaft connected with the two first gears, the first gears of the left upper wheel and the first gears of the right upper gear being engaged with each other, the first shaft of the left upper wheel and the first shaft of the right upper wheel being rotatably disposed on the upper base and the first shaft of the left upper wheel having a first inner wall, a first outer wall, and three first insertion grooves disposed between the first inner wall and the first outer wall, the torsion spring being connected with the first shaft of the left upper wheel and the first shaft of the right upper wheel;

a cord rolling unit having a lower base, a left lower wheel, a right lower wheel, and two transmission cords, the lower base being detachably mounted to a bottom of the upper base of the driving unit, the left lower wheel being coaxially mating with the left upper wheel of the driving unit, each of the left lower wheel and the right lower wheel being provided with two opposite second gears and a second shaft connected with the two second gears, the second gears of the left lower wheel and the second gears of the right lower wheel being engaged with each other, the second shaft of the left lower wheel and the second shaft of the right lower wheel being rotatably disposed on the lower base and the second shaft of the left lower wheel having a second inner wall, a second outer wall, and a three second insertion grooves disposed between the second inner wall and the second outer wall, the transmission cords being directly connected with the second shaft of the left lower wheel and the second shaft of the right lower wheel respectively; and a transmission member having three insertion portions inserted in the first and second insertion grooves.

2. The double-layer cord rolling device as claimed in claim 1, wherein the first inner wall of the left upper wheel is rotatably disposed on the upper base; the first outer wall of the left upper wheel is coaxially sleeved on the first inner wall and fixedly connected with the first gears of the left upper wheel; the first shaft of the left upper wheel has the three first insertion grooves and three first ribs connected between the first inner and outer walls and equiangularly spaced around a center of the first shaft of the left upper wheel so that each of said three first insertion grooves is defined between the first inner wall, the first outer wall, and a respective two adjacent ribs of said three first ribs; the second inner wall of the left lower wheel is rotatably disposed on the lower base; the second outer wall of the left lower wheel is coaxially sleeved on the second inner wall and fixedly connected with the second gears of the left lower wheel; and the second shaft of the left lower wheel has the three second insertion grooves and three second ribs connected between the second inner and outer walls and equiangularly spaced around a center of the second shaft of the left lower wheel so that each of said three second insertion grooves is defined between the second inner wall, the second outer wall, and a respective two adjacent ribs of said three second ribs; the transmission member has an annular portion and the three insertion portions connected with the annular portion and equiangularly spaced around a center of the annular portion so that an upper hole located above the annular portion and a lower hole located under the annular portion are jointly defined by the three insertion portions respectively; an upper notch located above the annular portion and a lower notch located under the annular portion are defined between two adjacent portions of said three insertion portions respectively; the upper hole is sleeved on the first inner wall of the first shaft of the left upper wheel; the lower hole is sleeved on the second inner wall of the second shaft of the left lower wheel; the upper notch is engaged with one of the three first ribs; the lower notch is engaged with one of the three second ribs.

3. The double-layer cord rolling device as claimed in claim 1, wherein a cross section of the three first insertion grooves, a cross section of the three second grooves, and a cross section of the three insertion portions are arc-shaped.

* * * * *